United States Patent [19]

Ohgake et al.

[11] Patent Number: 5,034,144

[45] Date of Patent: Jul. 23, 1991

[54] LUBRICATING OIL COMPOSITIONS FOR FOOD PROCESSING MACHINES

[75] Inventors: Ryoji Ohgake, Chiba; Mitsuo Okada, Yokohama; Hiroyuki Takashima, Yokohama, all of Japan

[73] Assignee: Nippon Oil Co., Ltd., Tokyo, Japan

[21] Appl. No.: 476,816

[22] Filed: Feb. 7, 1990

[30] Foreign Application Priority Data

Feb. 10, 1989 [JP] Japan ..... 1-29747

[51] Int. Cl.[5] ..... C10M 105/36

[52] U.S. Cl. ..... 252/565; 252/56 R

[58] Field of Search ..... 252/565

[56] References Cited

U.S. PATENT DOCUMENTS

| | | | |
|---|---|---|---|
| 2,808,421 | 10/1957 | Brokaw | 252/565 |
| 3,126,344 | 3/1964 | Matuszak | 252/565 |
| 3,579,548 | 5/1971 | Whyte | 252/565 |
| 4,108,785 | 8/1978 | Stunwold | 252/565 |
| 4,217,390 | 8/1980 | Newkirk et al. | 252/565 |
| 4,637,887 | 1/1987 | Warschech et al. | 252/565 |
| 4,783,274 | 11/1988 | Jokinen et al. | 252/565 |

*Primary Examiner*—Prince E. Willis
*Assistant Examiner*—E. McAvoy
*Attorney, Agent, or Firm*—Bucknam and Archer

[57] ABSTRACT

Lubricating oil compositions favorably used for food processing machines are disclosed. The oil compositions exhibit highly improved oxidation stability, wear resistance and rust prevention. Raw materials quite harmless to human bodies can be used in the production of said lubricating oil composition which comprises (I) as the base oil, a saturated fatty acid glyceride represented by the following general formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ are each a straight-chain alkyl group and (II) as an essential component, a fatty acid in an amount of 0.001 to 5% by weight, based on the total composition.

9 Claims, No Drawings

LUBRICATING OIL COMPOSITIONS FOR FOOD PROCESSING MACHINES

BACKGROUND OF THE INVENTION

1. Field of the Invention

The present invention relates to lubricating oil compositions for food processing machines and more particularly to such a composition having excellent properties and comprising a saturated fatty acid glyceride as the base oil and at least one fatty acid as the essential component.

2. Prior art

Various food processing machines have heretofore been used in all steps for producing foodstuffs from raw materials such as agricultural, live-stock and marine products by their fine selection, classification, grinding, mixing, roasting, heating, fermentation, boiling condensation, drying and freezing. The main machines include agricultural products-processing machines such as a machine for polishing rice or wheat, a machine for milling grains, a fermentation machine for producing rice wine, soy or miso, a machine for making noodle, a machine for making bread, a machine for making cakes and a processing machine for preparing juices, jams or pickles; live-stock products-processing machines such as a milk-processing machine, a machine for preparing dairy goods such as cheese and butter and a meat processing machine for preparing ham and sausage; a marine products-processing machines such as a fish-processing machine and a seaweeds-processing machine; and machines for preparing additives for food, natural flavors and pharmaceutical goods, such as a vacuum film evaporator and a machine for kneading.

As the above food-processing machine are used for preparing foodstuffs and creating favorite tastes for human beings, they should receive careful attention to confirm that they are safe and hygienic for said purpose.

Accordingly, from the standpoint of safety, animal and vegetable oils as well as liquid paraffin have been used as a lubricating oil for application to the bearings, gears, sliding guide surfaces and oil pressure systems of food processing machines However, in case of using animal and vegetable oils, there are problems as to oxidation stability, rust prevention or corrosion resistance. On the other hand, in case of using liquid paraffin, there are problems as to low-temperature characteristics and lubricity and, furthermore, it contains aromatic compounds, though in a very small amount, which are harmful for human bodies, because it is an oil obtained by refining a mineral oil. Consequently, for food additive uses, liquid paraffin used only as a releasing agent for bakery uses in the field of food industry. Thus, development of new types of lubricating oils having superior properties to those of the conventional oils such as animal and vegetable oils or liquid paraffin, has been required

SUMMARY OF THE INVENTION

The present inventors made intensive studies in an attempt to develop a lubricating oil having excellent properties for use in food processing machines and, as a result of their studies, they found that saturated acid glycerides having a specific structure will show various superior performances as compared with the conventional oils such as animal and vegetable oils or liquid paraffin when fatty acids are added to the acid glycerides. This invention is based on this finding or discovery.

The object of the present invention is to provide lubricant oil compositions which are useful for food processing machines, are superior in oxidation stability, rust prevention and lubricity and are quite harmless for human bodies as compared with the conventional lubricating oils.

The object of the present invention is achieved by providing a lubricating oil composition used for food processing machines which comprises (I) as the essential base oil, a saturated fatty acid glyceride represented by the following general formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ may be identical with, or different from, each other, and are each straight-chain alkyl group having 5 to 21 carbon atoms, and (II) as an essential component, an aliphatic acid having 12 to 22 carbon atoms in an amount of 0.001 to 5% by weight, based on the total composition.

This invention will be explained below in more detail.

A saturated fatty acid glyceride (I) used in the present invention is represented by the following general formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ may be identical with, or different from, each other, and are each straight-chain alkyl group having 5 to 21, preferably 5 to 11, carbon atoms. If there is used such a glyceride which contains straight-chain alkyl groups having carbon atoms the number of which is outside said range defined in the invention, contains branched-chain alkyl groups or contains unsaturated groups, the resulting oil composition will not be satisfactory in viscosity, pour point, oxidation stability and the like.

The $R_1$, $R_2$ and $R_3$ in the general formula representing the straight-chain alkyl group in said saturated fatty acid glyceride (I) used in the present invention each include pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl and heneicosyl groups.

Although a method for producing the saturated aliphatic acid glyceride (I) is not specified, a typical one comprises the steps of hydrolyzing natural oils or fats to separate glycerin from the corresponding fatty acids, extracting only saturated fatty acids therefrom and reacting said extracted saturated fatty acids with said glycerin to obtain the glyceride (I).

The saturated fatty acid glyceride (I) used in the present invention is quite harmless for human bodies as is apparent from the fact that the glyceride has been designated as a food additive.

The component (II) used in the present invention is a fatty acid having 12 to 22 carbon atoms, preferably a saturated a fatty acid having 12 to 18 carbon atoms. If there is used a fatty acid having carbon atoms the number of which is outside said range defined in the invention, the resulting oil composition will disadvantageously be inferior in oxidation stability, lubricity and the like.

The fatty acids having 12 to 22 carbon atoms used in the present invention, may be naturally occurring ones or synthetic ones, and include lauric acid, tridecyl acid, myristic acid, pentadecyl acid, palmitic acid, heptadecyl acid, stearic acid, nonadecanoic acid, arachic acid, behenic acid, oleic acid, elaidic acid, cetoleic acid, erucic acid, brassidic acid, linoleic acid, linolenic acid, arachidonic acid, stearolic acid and mixtures thereof.

These fatty acids are quite harmless for human bodies as is apparent from the fact that they have been designated as flavor additives for food and have been also nominated for standard items of raw materials for cosmetics.

The amount of the component (II) used in the present invention is in the range of 0.001 to 5% by weight, preferably of 0.01 to 0.2% by weight, based on the total composition. If the amount is less than those defined in the invention, the resulting oil composition will unfavorably unsatisfactory in lubricity and rust prevention. If the amount is over the range defined in the invention, the oxidation stability of the resulting oil composition will unfavorably be decreased and the corrosiveness thereof against metals will unfavorably be increased. The addition of the component (II) brings about advantageous effects in the removal of the odor and taste the base oil originally has.

According to the present invention, a saturated fatty acid glyceride (I) as the base oil, is incorporated with a specified amount of an fatty acid having 12–22 carbon atoms (II) as the essential component, thereby to obtain a lubricating oil composition, which is excellent in various performances, for use in food processing machines. Furthermore, other additives may be added to the oil composition in order to enhance the composition in performances as such.

However, such additives selected should be harmless to human bodies and, for this reason, they may include higher aliphatic alcohols such as oleyl alcohol; animal and vegetable oils or those partially hydrogenated; higher aliphatic acid esters such as methyl laurate and butyl stearate; oxidation preventives such as tertiarybutyl hydroxyanisole, dibutyl hydroxytoluene and vitamin E; sorbitane aliphatic acid esters which are a rust preventive, such as sorbitane monooleate; and sucrose aliphatic acid esters such as sucrose monolaurate. Among these additives, there are those having delicate effects on the odor or taste of materials to be processed; such additives should preferably not be used if the odor or taste is a major problem to the products The additives may be used singly or jointly Although the amount of the additive used is not specified, the preferable amount of one additive used is 20% or less by weight, more preferably 0.1% to 10.0% by weight, based on the total composition.

PREFERRED EMBODIMENTS

The present invention will now be described in more detail by referring to the following Examples and Comparative Examples.

EXAMPLES 1 and 2 AND COMPARATIVE EXAMPLES 1 to 3

There were obtained lubricating oil compositions each having the constitution shown in Table 1 and used for food processing machines of the present invention (Examples 1 and 2). The compositions so obtained were measured for their characteristics and performances by the following methods, and the results are shown in Table 1.

[Oxidation stability]

The stability against oxidation (in min.) of the oil composition was measured according to "The rotary bombé type oxidation stability test method" prescribed in JIS K 2514 3.3.

[Wear resistance]

Using the oil composition, the wear (mm) in diameter was measured in terms of wear resistance according to "Wear preventive characteristics of lubricating fluid (FOUR-BALL METHOD)" prescribed in ASTM D 4172 under the condition of 1,200 rpm, 15 kg and 30 min.

[Rust prevention]

The rust preventiveness characteristics of the oil composition was measured according to "The method of testing the rust preventiveness of lubricating oils (The method using distilled water)" prescribed in JIS K 2510.

[Odor]

In Table 1, the mark "" indicates a lubricating oil composition which was not appreciated to smell, and the mark "Δ" indicates such a composition which was slightly appreciated to smell.

For the sake of comparison, a base oil which was not incorporated with a component (II) (Comparative 1), an animal and vegetable oil which is conventionally used as a lubricating oil for food processing machines (Comparative 2) and liquid paraffin (Comparative 3) were evaluated for their respective characteristics and performances with the results being also shown in Table 1.

TABLE 1

| | Example, Comp. Example | | | | |
|---|---|---|---|---|---|
| | Ex. 1 | Ex. 2 | Comp. 1 | Comp. 2 | Comp. 3 |
| Composition (wt. %) | | | | | |
| saturated fatty acid triglyceride having $C_8$ and $C_{10}$ | 99.9 | 99.4 | 100 | animal/ vegetable oil | liquid paraffin |
| stearic acid | 0.1 | 0.1 | — | | |
| dibutyl hydroxy-toluene | — | 0.5 | — | | |
| Characteristics and performances | | | | | |

TABLE 1-continued

| | Example, Comp. Example | | | | |
|---|---|---|---|---|---|
| | Ex. 1 | Ex. 2 | Comp. 1 | Comp. 2 | Comp. 3 |
| oxidation stability (endurance of stability against oxidation, min.) | 62 | 198 | 62 | 10 | 29 |
| wear resistance (wear in dia., mm) | 0.38 | 0.39 | 0.50 | 0.48 | 0.52 |
| rust preventiveness | no rust | | rusted | | |
| safety | excellent | | | | limited in use |
| odor | | -Δ | Δ | | |

As is seen from the results of Table 1, Examples 1 and 2 which consist of a composition of the present invention show a great improvement in characteristics and performances such as oxidation stability and lubricity (wear resistance) as compared with Comparative Examples 2 and 3 consisting respectively of an animal and vegetable oil and liquid paraffin. The rust preventiveness of Examples 1 and 2 is also excellent. Furthermore, it is clearly seen that the lubricity (wear resistance) and rust preventiveness of Comparative Example 1 are inferior than those of Examples 1 and 2 although Examples 1, 2 and Comparative Example 1 were composed of the same base oil of (I) according to the present invention. The reason for this is that the sample of Comparative Example 1 did not contain a component (II) described in the present invention.

Effect of the Invention

As is seen from the foregoing, the compositions of the present invention which comprise a specified saturated fatty acid glyceride as the base oil and a fatty acid (II) in a specified amount, are superior in various performances such as oxidation stability, rust preventiveness and wear resistance and in addition, the compositions are quite harmless to human bodies Consequently, the compositions of the present invention are preferable for use as lubricating oils for food processing machines.

What is claimed is:

1. A lubricating oil composition for food processing machines which consists essentially of (I) as the base oil, a saturated fatty acid glyceride of formula $$\begin{array}{l} CH_2-OCOR_1 \\ | \\ CH-OCOR_2 \\ | \\ CH_2-OCOR_3 \end{array}$$

wherein $R_1$, $R_2$ and $R_3$ are the same or different and are each a straight-chained alkyl group having 5 to 21 carbon atoms, and (II) as an essential component, a monocarboxylic fatty acid having 12 to 22 carbon atoms in an amount of 0.01 to 5% by weight, based on the total composition.

2. A lubricating oil composition according to claim 1 wherein $R_1$, $R_2$ and $R_3$ in the formula of said saturated fatty glyceride are each an alkyl group having 5 to 11 carbon atoms.

3. A lubricating oil composition according to claim 1, wherein said fatty acid has 12 to 18 carbon atoms.

4. A lubricating oil composition according to claim 2, wherein said fatty acid has 12 to 18 carbon atoms.

5. A lubricating oil composition according to claim 1, wherein the amount of said fatty acid used is 0.01 to 0.2% by weight, based on the total composition.

6. A lubricating oil composition according to claim 2, wherein the amount of said fatty acid used is 0.01 to 0.2% by weight, based on the total composition

7. A lubricating oil composition according to claim 3, wherein the amount of said fatty acid used is 0.01 to 0.2% by weight, based on the total composition.

8. The composition according to claim 1 wherein said essential component II is a member selected from the group consisting of lauric acid, tridecyl acid, myristic acid, pentadecyl acid, palmitic acid, heptadecyl acid, stearic acid, nonadecanoic acid, arachic acid, behenic acid, oleic acid, elaidic acid, cetoleic acid, erucic acid, brassidic acid, linoleic acid, linolenic acid, arachidonic acid, stearolic acid and mixtures thereof.

9. The composition according to claim 1 wherein in said saturated fatty acid glyceride the fatty acid is obtained by hydrolyzing natural oils or fats to separate glycerin from the fatty acid, extracting only the saturated fatty acids and reacting said saturated fatty acids with glycerin to obtain said saturated fatty acid glyceride.

* * * * *